United States Patent [19]

Watson

[11] Patent Number: 4,810,191

[45] Date of Patent: Mar. 7, 1989

[54] PROCESSING STEEL SLABS

[75] Inventor: James T. Watson, Chepstow, United Kingdom

[73] Assignee: British Steel plc, United Kingdom

[21] Appl. No.: 87,404

[22] Filed: Aug. 20, 1987

[30] Foreign Application Priority Data

Aug. 23, 1986 [GB] United Kingdom ..... 8620583

[51] Int. Cl.[4] ..... F27D 3/12; C21D 1/06

[52] U.S. Cl. ..... 432/241; 432/136; 266/253

[58] Field of Search ..... 432/239, 241, 136, 141; 266/253

[56] References Cited

U.S. PATENT DOCUMENTS

| | | | |
|---|---|---|---|
| 3,836,325 | 9/1974 | Nakamara et al. | 432/241 |
| 4,421,481 | 12/1983 | Holz et al. | 432/241 |
| 4,610,628 | 9/1986 | Mizushina | 432/241 |

FOREIGN PATENT DOCUMENTS

| | | | |
|---|---|---|---|
| 3502343 | 7/1986 | Fed. Rep. of Germany | 432/241 |
| 330844 | 6/1930 | United Kingdom . | |
| 1034010 | 6/1966 | United Kingdom . | |

*Primary Examiner*—Henry C. Yuen

*Attorney, Agent, or Firm*—Bacon & Thomas

[57] ABSTRACT

A method of processing steel slabs in which the slabs are continuously routed through a furnace to a slabbing mill the slabs being sequentially charged through the bottom of the furnace by a reciprocating mechanism whereby on the upward stroke the slab charged engages and lifts the slabs piled above it and is then securely held (via jaws) until engaged itself in the next cycle by the succeeding slab. The top slab is discharged during each cycle whereby the number of slabs in the pile in consistent and all are heated on their exposed surfaces during their period in the furnace.

This invention maximises the use of the residual heat from the cast slab where 'sizing' is to be performed.

6 Claims, 4 Drawing Sheets

PROCESSING STEEL SLABS

This invention relates to a method of processing steel slabs.

Steel slabs issuing from a continuous casting machine are routed through a re-heating furnace to a slabbing mill and thence to a roughing mill preparatory to the rolling of plate. Slabs may be either cast to size or they may be 'sized' from their cast dimension in, say, a universal slabbing mill. In practice, in any one plant the majority of slabs need to be sized. Thus different routing requirements via further re-heating furnaces need to be devised for each since, prior to mill processing, slabs of the same size must, for ready accessibility, be sited together in these furnaces or stored in a pre-determined size relationship e.g. for the so-called coffin shaped rolling schedule. Slabs to be sized must be re-heated to bring their 'cold' edges up to the appropriate temperature for sizing in the universal slabbing mill and with tapered slabs (as will be produced with size changes effected through an adjustable mould in the continuous casting machine) there are restrictions in the design of furnace which may be employed, the conventional pusher-type furnace cannot be used because of the risk of jamming.

Thus, these multi-stage routing requirements which are essential to secure satisfactory rolling schedules are nevertheless necessarily less efficient, particularly in the use of energy, than a single dedicated route.

It is an object of this invention to provide an improved method of processing steel slabs.

The present invention provides a method of processing steel slabs in which the slabs are continuously routed through a furnace to a slabbing mill, the slabs being sequentially charged through the bottom of the furnace by a reciprocating mechanism whereby on the upward stroke the slab charged engages and lifts the slabs piled above it and is then securely held until engaged itself in the next cycle by the succeeding slab, the top slab being discharged during each cycle whereby the number of slabs in the pile is consistent and all are heated on their exposed surfaces during their period in the furnace.

The invention also provides apparatus for processing steel slabs through a furnace in which slabs are held in a vertically stacked pile, comprising slab charging means including a reciprocable mechanism whereby on the upward stroke the slab charged engages the bottom of the pile and lifts the same, supporting means operable to engage and hold said slab prior to the downward reciprocal stroke, and discharge means for discharging the top slab of the pile during each cycle whereby the number of slabs in the pile is consistent, the furnace, including heating means such that all the slabs are heated on their exposed surfaces during their period in the furnace.

The charged slab supporting the slabs stocked above it may be securely held solely by jaws clamped against the edges of said slab.

This vertical 'stack' furnace may readily accommodate tapered slabs and the slabs are heated at their edges such that they can be sized if required in the slabbing mill—those already cast to size can pass straight through the mill; all slabs can then be routed as appropriate direct to a mill or through reheating furnaces prior to roughing, which furnaces may be of any convenient design, including pusher-type.

This invention maximises the use of the residual heat from the cast slab either on a direct rolled route or where sizing is to be performed and since the bulk temperature will be more consistent in the slabs transported to the "downstream" re-heating furnaces further reductions in energy consumption may be achieved here compared with practice hitherto. The adoption of the vertical stack furnace also reduces the incidence of scale.

In order that the invention may be fully understood, one embodiment thereof will now be described with reference to the accompanying drawings, in which.

Figure 1:
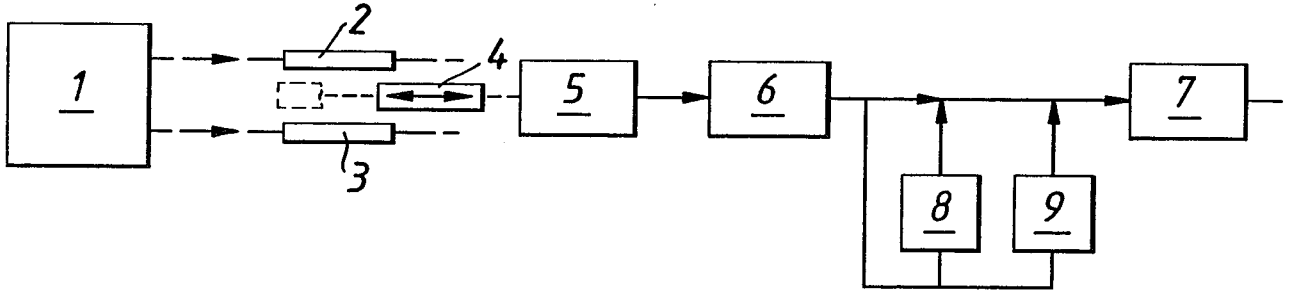
FIG. 1 is a schematic illustration of the plant utilised, and the slab routing adopted, in a method according to this invention.

Referring now to FIG. 1, slabs issue in twin strands from a continuous casting machine 1, are cut to length and are transported to tables 2,3 from which they are propelled, alternately from one and then the other, on to a reciprocating 'buggy' 4. The buggy transports its loaded slab via a slab positioning/alignment station (not shown) to a vertical stack reheating furnace 5, the slabs being sequentially loaded into the bottom of the furnace and discharged from the top. The discharged slabs are transported to a universal slabbing mill 6 and routed directly to a roughing mill 7 or, via re-heating furnaces 8,9 in accordance with the rolling sequence desired.

Figure 2:
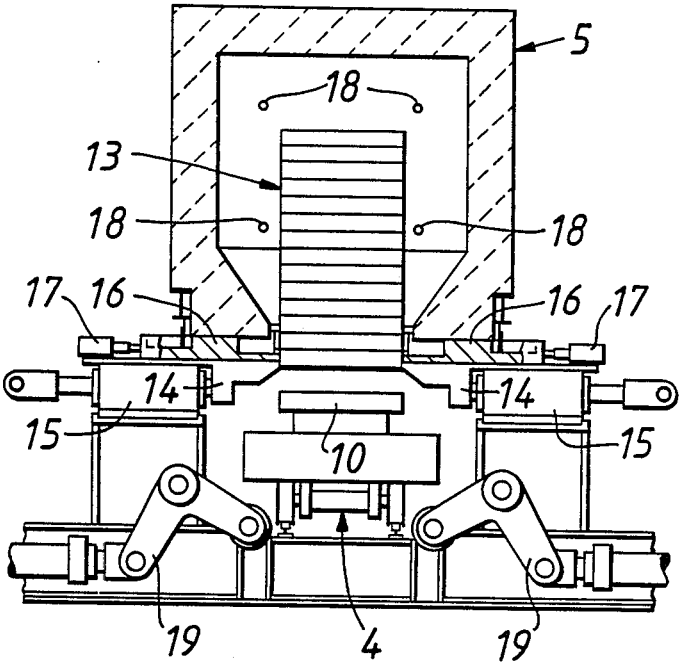
FIG. 2 is a sectional end elevation of the vertical stack furnace before entry of a succeeding slab.
Figure 3:
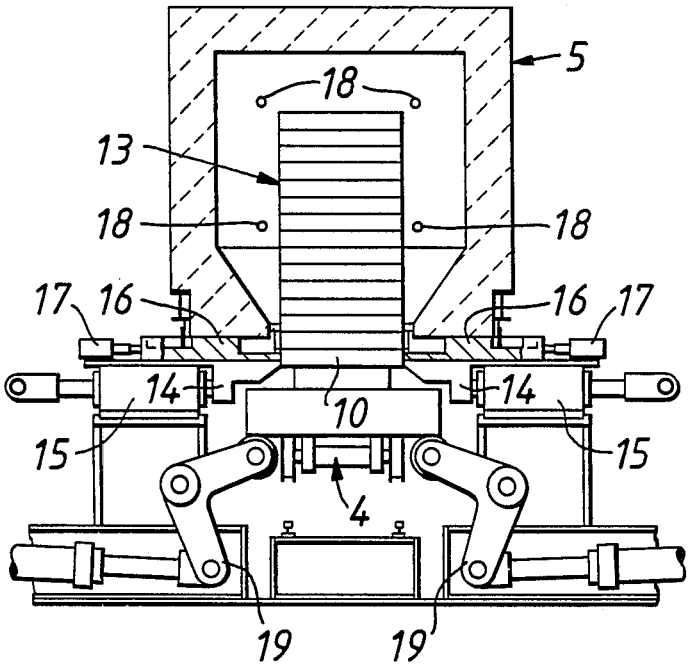
FIG. 3 is the same view as FIG. 2 but with the slab having just been introduced.
Figure 4:
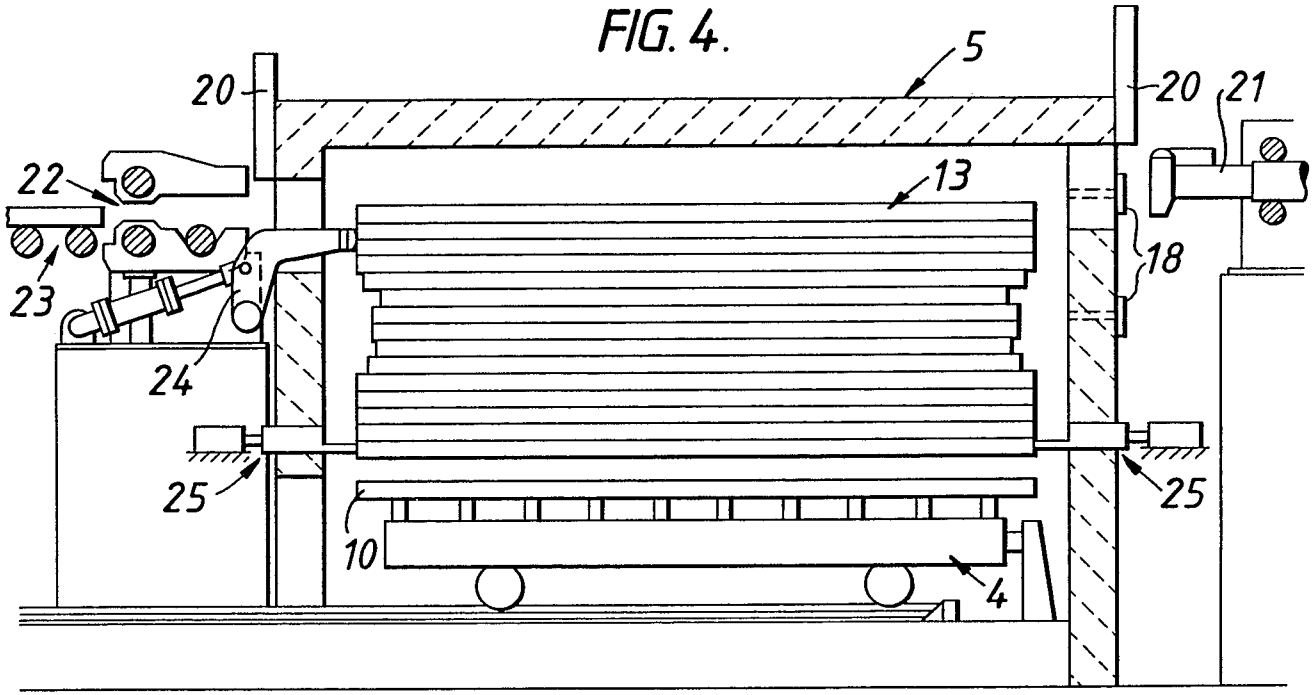
FIG. 4 is a schematic side elevation of the furnace.

The vertical stack furnace, the key plant in this invention, is illustrated more particularly in FIGS. 2,3 and 4.

Referring now to FIG. 2, the buggy 4 has a slab 10 mounted on it and is positioned beneath the furnace 5.

The furnace is shown to contain a stack of slabs 13 all of which are supported on the lowermost slab which itself is securely held along its opposite sides between a number of jaws 14 each operated by an hydraulic ram 15—there are a number, e.g. six, of these jaws/rams extending along each side of the furnace. Fibrous refractory seals 16 additionally mate with the sides of the bottom slab—again these are hydraulically activated by units 17.

The furnace is U-fired via end burners 18 by which the exposed surfaces of the slabs are heated.

Positioned beneath the buggy 4 is a bell crank mechanism 19 and this is reciprocally operable to raise the slab 10 into engagement with the stack. Thus, referring now to FIG. 3, the mechanism 19 is shown in its raised position immediately prior to retraction with the slab 10 now firmly clamped in the lowermost position of the stack, the jaws 14 having opened during the latter part of the upward stroke (with the slab 10 engaged with the stack) to permit the whole stack to be raised by the mechanism 19.

The uppermost slab on the stack is now in line for discharge.

Referring now to FIG. 4 the furnace is shown in side elevation. Pusher mechanism 21 is reciprocally operable to engage the top slab and discharge it via pinch rolls 22 to a run-out table 23, an hydraulically operable stop arm 24 being positioned against the next lower slab in the stack to prevent this being dragged over by 'sticktion' with the top slab.

The buggy 4 is shown with the next slab in position (longitudinally); it is then raised by mechanism 19 into a rest position immediately beneath the lower slab to restrict heat losses from its exposed surface. To complete the furnace seal further fibrous refractory seals are provided at the ends—these are shown at 25.

The cycle is completed on discharge.

In accordance with this invention therefore, a most efficient method of processing continuously cast slabs is provided by utilising the vertical stack slab edge reheat furnace described. The slabs issuing from this furnace are of a consistent temperature eminently suitable for flat or edge rolling maximising the use of adjustable moulds in the casting machine since tapered slabs can be edge reduced for proper sizing, and thus mill scheduling; additionally, yield is improved by avoiding fishtails. The reduced residence time of the slabs compared with other process routes and the restriction in the surface area exposed also reduces the incidence of scale. The type and siting of the furnace maximises the use of the residual heat from the cast slab enabling significant energy savings to be achieved.

Although this invention has been described with reference to the particular embodiment illustrated with reference to the drawings it is to be understood that these are illustrative only and various modifications may be made without departing from the scope of this invention. In particular, the design of the furnace seals may be different from that shown consistent with the retention of heat and containment of fume. The furnace may be side fired instead of end fired.

Any possibility of slab surface scuffing during discharge may be minimised by the use of parting compounds and an alternative mechanism to the stop arm 24 may be employed to hold the next-to-top slab during discharge; more speedy discharge may be effected by having an arm permanently protruding through the furnace door aperture with only restricted movement into and out of contact with the appropriate slab. This would also enable the pinch rolls 22 to be sited closer to the furnace, thus in turn reducing the stroke required for pusher mechanism 21. Energy losses would also be reduced in the sense that door 20 would be open for a shorter period.

Additionally, provision may be made for temporarily holding the furnace stock from below so as to relieve the duty on the jaws 14. This could be effected by moving supports into position beneath the lowermost slab immediately after the jaws have clamped same and the slab buggy has been shunted back to tables 2,3. Alternatively the buggy itself, loaded or otherwise, can be utilised for this purpose, being raised into contact with the lowermost slab and held there by the mechanism 19. Of course, it is not essential for the whole buggy to be lifted from the rail track, only the upper part need be so raised if such a design were deemed desirable.

Further, the jaws 14 as shown are exemplary only, other shapes formed in the manner of curved protrusions may be preferred consistent with securing an adequate grip on the slabs and rolling out the impressions at a subsequent stage.

We claim:

1. Apparatus for processing rectangular section steel slabs through a furnace in which slabs are held in a vertically stacked pile comprising:

a furnace including heating means for heating the slabs on their exposed surfaces during their period in the furnace, slab charging means for charging slabs to the furnace including a reciprocating mechanism having an upward and a downward stroke whereby on the upward stroke a slab engages the bottom of the pile and lifts the same, reciprocating clamp means comprising a series of jaws by which said charged slab is supported along its opposing sides operable to engage and hold said slab prior to the downward reciprocal stroke of said reciprocating mechanism, and discharge means for discharging the top slab of the pile from the furnace whereby the number of slabs in the pile is consistent.

2. Apparatus according to claim 1, wherein said jaws each comprise a curved protrusion which grips the side of the slab.

3. The apparatus according to claim 1, further comprising means for transporting the slabs by a tracked buggy to a site beneath the furnace and for lifting the buggy together with the slab when the slat is charged to the bottom of the furnace.

4. The apparatus according to claim 3, further comprising auxiliary support means for supporting the charged slab from below following the downward stroke of said reciprocating mechanism and throughout the period when a slab is being transported by the buggy to the site beneath the furnace.

5. The apparatus according to claims 3 or 4, wherein the buggy is maintained in close proximity to the exposed surface of the last charged slab to restrict energy losses therefrom.

6. The apparatus according to claim 3 or 4, further comprising a ram for discharging the top slab and means for restraining the slab immediately beneath and in contact with the top slab from sympathetic functional movement during discharge of the top slab.

* * * * *